US008651198B2

(12) United States Patent
Ito

(10) Patent No.: US 8,651,198 B2
(45) Date of Patent: Feb. 18, 2014

(54) SPINDLE LOCK DEVICES FOR SCREWDRIVERS

(75) Inventor: Miyabi Ito, Anjo (JP)

(73) Assignee: Makita Corporation, Anjo-Shi (JP)

( * ) Notice: Subject to any disclaimer, the term of this patent is extended or adjusted under 35 U.S.C. 154(b) by 619 days.

(21) Appl. No.: 11/785,529

(22) Filed: Apr. 18, 2007

(65) Prior Publication Data

US 2007/0267207 A1 Nov. 22, 2007

(30) Foreign Application Priority Data

Apr. 20, 2006 (JP) ..... 2006-116767

(51) Int. Cl.
*B25D 15/00* (2006.01)

(52) U.S. Cl.
USPC ..... 173/93.5; 173/109

(58) Field of Classification Search
USPC ..... 227/10; 173/93.5, 109
See application file for complete search history.

(56) References Cited

U.S. PATENT DOCUMENTS

| | | | | |
|---|---|---|---|---|
| 5,016,501 | A | 5/1991 | Holzer, Jr. | |
| 5,788,021 | A * | 8/1998 | Tsai | 188/67 |
| 6,152,242 | A * | 11/2000 | Chung | 173/48 |
| 6,311,787 | B1 * | 11/2001 | Berry et al. | 173/176 |
| 6,547,053 | B2 * | 4/2003 | Shih | 192/55.61 |
| 6,702,090 | B2 * | 3/2004 | Nakamura et al. | 192/223.2 |
| 6,805,206 | B2 * | 10/2004 | Hanke | 173/48 |
| 6,926,095 | B2 * | 8/2005 | Chen | 173/48 |
| 7,308,948 | B2 * | 12/2007 | Furuta | 173/48 |
| 7,377,331 | B2 * | 5/2008 | Chen | 173/93.5 |
| 2002/0121384 | A1 * | 9/2002 | Saito et al. | 173/109 |
| 2007/0034398 | A1 * | 2/2007 | Murakami et al. | 173/210 |
| 2007/0132196 | A1 * | 6/2007 | Puzio et al. | 279/2.21 |
| 2007/0267207 | A1 * | 11/2007 | Ito | 173/217 |
| 2008/0060487 | A1 * | 3/2008 | Schell | 81/469 |

FOREIGN PATENT DOCUMENTS

| | | | | |
|---|---|---|---|---|
| DE | 43-28-599 | A1 | 3/1994 | |
| EP | 0-792-723 | A2 | 9/1997 | |
| JP | U 58-160774 | | 10/1983 | |
| JP | 05-269677 | | 10/1993 | |
| JP | 2001-088052 | | 4/2001 | |
| JP | P2005-235032 | * | 8/2005 | B25D 17/24 |

OTHER PUBLICATIONS

Office Action issued in JP Application No. 2006-116767 on Nov. 16, 2010 (with English translation).

* cited by examiner

*Primary Examiner* — Hemant M Desai
*Assistant Examiner* — Gloria R Weeks
(74) *Attorney, Agent, or Firm* — Oliff PLC

(57) ABSTRACT

A spindle lock device includes an engaging ring fixed in position relative to a body case of an impact screwdriver. A flat relief surface is definable on an outer circumference of the anvil that can be disposed inside of the engaging ring. An engaging member can be disposed between the engaging ring and the flat surface of the anvil. The engaging member can wedge between the engaging ring and an end portion in the circumferential direction of the relief surface of the anvil, so that the anvil is locked with respect to rotation relative to the body case.

14 Claims, 9 Drawing Sheets

SPINDLE LOCK DEVICES FOR SCREWDRIVERS

This application claims priority to Japanese patent application serial number 2006-116767, the contents of which are incorporated herein by reference.

BACKGROUND OF THE INVENTION

1. Field of the Invention

The present invention relates to spindle lock devices for screwdrivers, and in particular to lock devices for locking a spindle of a screwdriver against a body case of the screwdriver in order to prevent rotation of the spindle.

2. Description of the Related Art

A known impact screwdriver has a spindle and an impact device that includes a hammer rotatably driven by a motor and an anvil attached to the spindle. The hammer can move toward and away from the anvil in order to intermittently apply impacts on the anvil for rotating the spindle. More specifically, when an external torque (screw tightening resistance) has applied to the anvil, the hammer moves axially away from the anvil, so that the hammer applies no impact to the anvil. Therefore, it is possible to firmly tighten screws by a predetermined tightening torque. Such a known impact screwdriver is disclosed, for example, in U.S. Pat. No. 5,016,501 and Japanese Laid-Open Utility Model Publication No. 58-160774.

However, in general, the screw tightening force is set by a compression spring that biases the hammer in the axial direction of the spindle. Therefore, it is not possible to apply a tightening force greater than a screw tightening force determined by the biasing force of the spring. Even if the entire screwdriver is rotated in the tightening direction with the motor stopped, it is not possible to further tighten the screw since the hammer will move away from the anvil and rotate relative to the anvil.

Therefore, conventionally, a manually operable screwdriver is used for further tightening a screw by a larger torque after an impact screwdriver has tightened the screw. Because a separate manually driven screwdriver is needed for further tightening the screw, the conventional design described above is inefficient and difficult to work with.

Thus, there is a need in the art for a motor driven screwdriver that can more efficiently tighten a screw after the screw has been tightened by a set tightening torque.

SUMMARY OF THE INVENTION

One aspect according to the present invention includes a spindle lock device in a screwdriver. The screwdriver includes an electric motor disposed within the body case, a drive shaft rotatably driven by the motor, a hammer having a rotational axis and axially movably and rotatably supported on the drive shaft, and an anvil having a spindle portion and rotatable about the same axis as the rotational axis of the hammer. The spindle lock device includes an engaging ring fixed in position relative to a body case of the screwdriver. The anvil is disposed inside of the engaging ring. A flat relief surface can be defined on an outer circumference of the anvil. An engaging member is disposed between the engaging ring and the flat surface of the anvil. The engaging member can wedge between the engaging ring and an end portion in the circumferential direction of the relief surface of the anvil, so that the anvil is locked with respect to rotation relative to the body case.

With this arrangement, when the body case and eventually the engaging ring is rotated in a screw tightening direction on the condition that the anvil is not rotatably driven by the motor (i.e., the condition where the motor has been stopped), the engaging member wedges between the engaging ring and the relief surface of the anvil, so that the anvil is locked with respect to rotation. In this state, by rotating the body case or the entire screwdriver in the screw tightening direction, the screw can be tightened needing the anvil with the anvil directly locked against the body case and without via the impact device. Therefore, it is possible to tighten the screw by a larger torque than a torque availably by the impact device.

As described above, after the screw has been tightened by the operation of the impact device, it is possible to further tighten the screw by rotating the body case without removing the screwdriver from the screw. Therefore, it is not necessary to use a separate manually driven screwdriver in order to further tighten the screw. As a result, it is possible to rapidly perform the operation for further tightening the screw after the screw has been tightened by the rotation of the motor. For this reason, the operability of the impact screwdriver can be improved.

In addition, when the body case is rotated in a screw loosening direction on the condition that the anvil is not rotatably driven by the motor, the engaging member wedges between the engaging ring and the relief surface of the anvil, so that the anvil is locked with respect to rotation. Therefore, by rotating the body case or the entire screwdriver in the screw loosening direction, the screw can be loosened by a larger torque than a torque available by the impact device.

When the motor is started for tightening the screw, the engaging member will not wedge between the engaging ring and the relief surface of the anvil because the anvil rotates in the screw tightening direction relative to the body case. Thus, the engaging member is positioned between the engaging ring and the relief surface without causing wedging therebetween. Therefore, the anvil is permitted to rotate relative to the engaging ring and the body case in order to perform the tightening operation by the impact device.

In one embodiment, the anvil includes an impact receiving portion and the spindle portion separated from each other. The impact receiving portion includes first engaging portions. The spindle portion includes a second engaging portion engageable with the first engaging portions in the rotational direction, while the spindle portion can rotate relative to the impact receiving portion about the rotational axis within a predetermined range. The relief surface can be located on a circumferential surface of the spindle. The engaging member is positioned between the first engaging portions of the impact receiving portion in the circumferential direction.

With this arrangement, the position of the engaging member about the rotational axis of the spindle portion can be limited within a position between the first engaging portion. Therefore, rotating the impact receiving portion relative to the spindle portion can release the wedging condition of the engaging member between the engaging ring and the anvil.

In another embodiment, the engaging member is a cylindrical pin, so that the pin can rotate along the relief surface to wedge between the engaging ring and the end portion of the relief surface as the engaging ring is rotated relative to the anvil.

With this arrangement, as the engaging ring rotates relative to the anvil the engaging member rotates along the relief surface and then wedges between the engaging ring and the anvil in order to lock the anvil with respect to rotation relative to the body case. When the engaging ring is rotated in an opposite direction, the engaging member rotates along the relief surface in the opposite direction, so that the wedging condition of the engaging member is released. Therefore, the anvil is permitted to rotate relative to the body case for the tightening operation by means of the impact device.

In another aspect according to the present invention includes an impact screwdriver including a hammer and an anvil. A motor rotatably drives the hammer. The anvil has an impact receiving portion and a spindle portion rotatable relative to the impact receiving portion. The impact receiving portion is capable of rotating as the hammer applies an impact on the impact receiving portion in a rotational direction. The impact screwdriver further includes a lock device that has an operation member and a lock member. The lock member is capable of releasably locking the spindle portion from rotation relative to the operation member.

In one embodiment the operation member includes a lock ring rotatable relative to the spindle portion about a rotational axis. The spindle portion is disposed within the lock ring. The lock member is positioned between the lock ring and the spindle portion and is movable between a lock position and an unlock position in response to rotation of the lock ring.

In another embodiment, the lock ring includes an inner circumferential surface. The spindle portion includes a control surface opposed to the inner circumferential surface of the lock ring in a radial direction. The lock member is disposed within a lock space defined between the inner circumferential surface of the lock ring and the control surface of the spindle portion. The lock space has a radial distance decreasing from a central portion of the control surface in the circumferential direction toward opposite ends of the control surface. The radial distance of the lock space at the central position of the control surface is greater than a size of the lock member in the radial direction. The radial distance of the lock space at the opposite ends of the control surface is smaller than the size of the lock member in the radial direction. The lock member can wedge between the lock ring and the control surface as the lock member moves from a position opposing to the central portion of the control surface toward positions opposing to the end portions of the control surface.

The lock member may be a rolling member that can rotate along the control surface.

In a further embodiment, the impact receiving portion includes first engaging portions spaced from each other in the rotational direction. The spindle portion includes second engaging portions spaced from each other in the rotational direction. The second engaging portions respectively oppose to the first engaging portions in the rotational direction while permitting rotation of the spindle portion relative to the impact receiving portion within an angle of rotation. The lock space is defined between two of the first engaging portions.

In a still further embodiment, the impact screwdriver further includes a body case capable of rotatably receiving the hammer and the anvil. The operation member is attached to the body case, so that the operation member can rotate together with the body case relative to the anvil.

DETAILED DESCRIPTION OF THE INVENTION

Each of the additional features and teachings disclosed above and below may be utilized separately or in conjunction with other features and teachings to provide improved spindle lock devices and impact screwdrivers incorporating such spindle lock devices. Representative examples of the present invention, which examples utilize many of these additional features and teachings both separately and in conjunction with one another, will now be described in detail with reference to the attached drawings. This detailed description is merely intended to teach a person of skill in the art further details for practicing preferred aspects of the present teachings and is not intended to limit the scope of the invention. Only the claims define the scope of the claimed invention. Therefore, combinations of features and steps disclosed in the following detailed description may not be necessary to practice the invention in the broadest sense, and are instead taught merely to particularly describe representative examples of the invention. Moreover, various features of the representative examples and the dependent claims may be combined in ways that are not specifically enumerated in order to provide additional useful embodiments of the present teachings.

An embodiment according to the present invention will now be described with reference to FIGS. 1 to 10.

Figure 1:
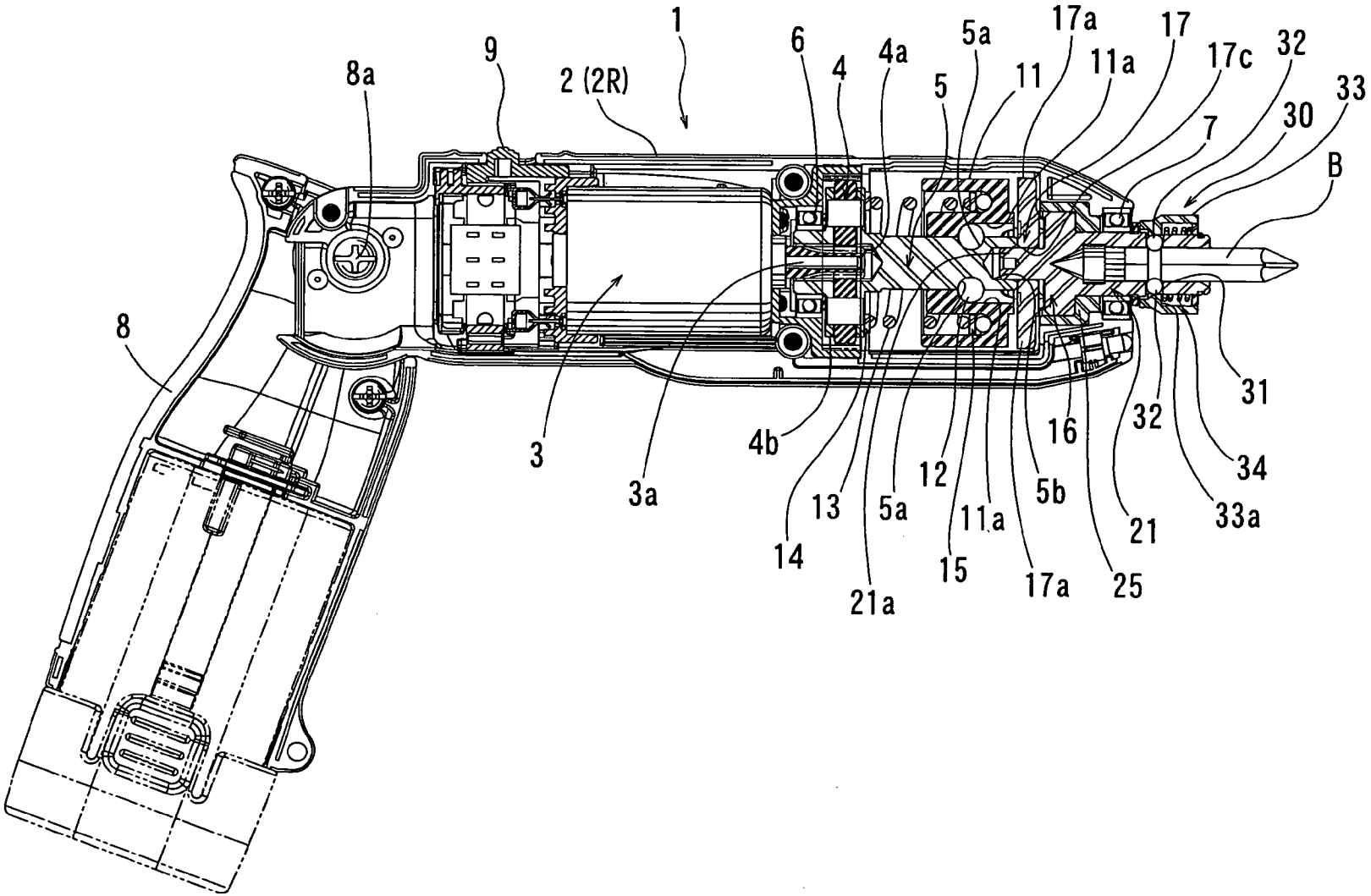
FIG. 1 is a side view of an impact screwdriver incorporating a spindle lock device according to an embodiment of the present invention and showing the impact screwdriver with its left side case half removed.
Figure 2:
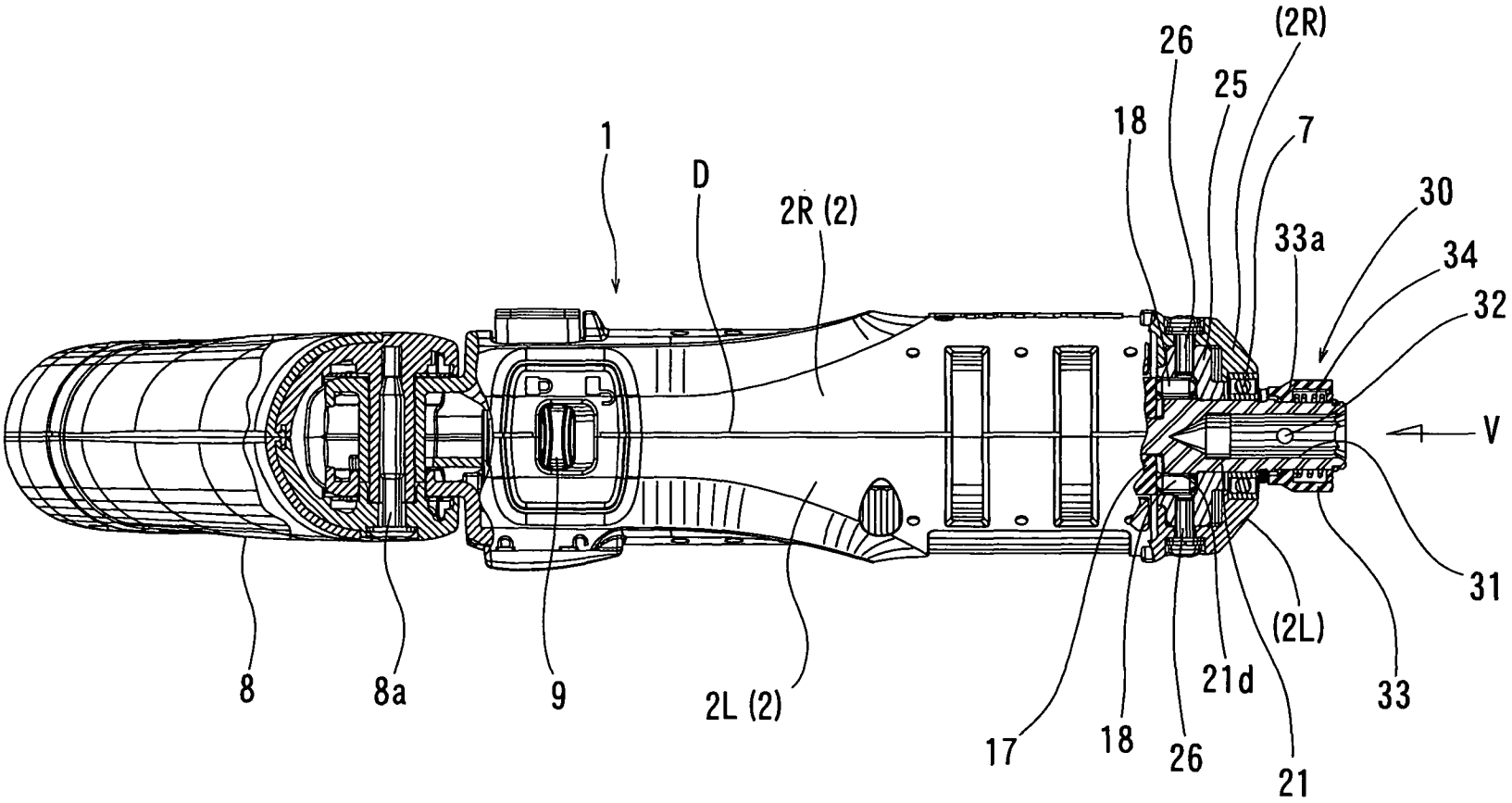
FIG. 2 is plan view of the impact screwdriver.
Figure 3:
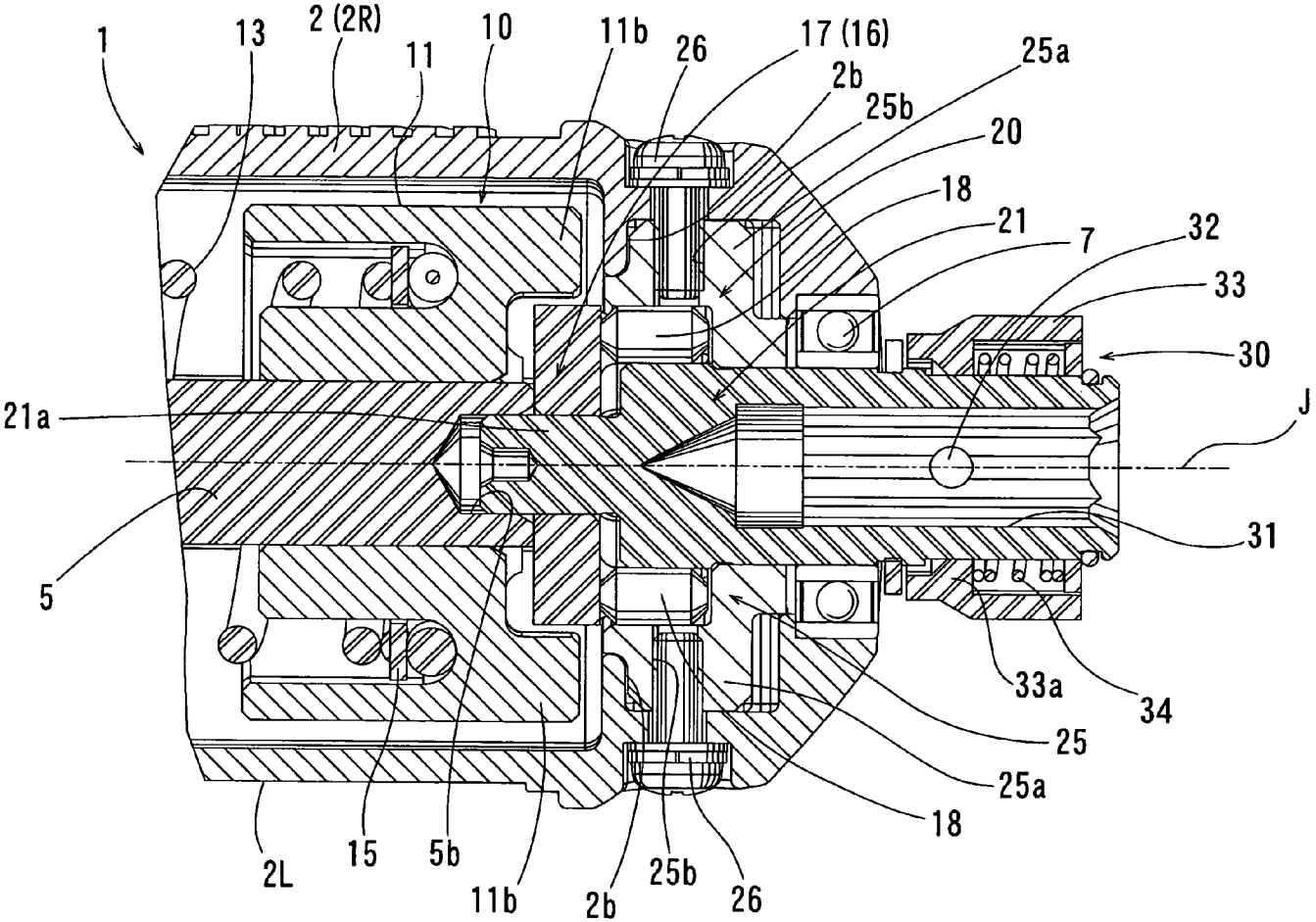
FIG. 3 is an enlarged view of a front portion of the impact screwdriver shown in FIG. 2 and showing an impact device and a spindle lock device in vertical sectional view.

As shown in FIG. 1, an impact screwdriver 1 incorporating a representative spindle lock device 20 is generally shown in FIGS. 1 and 2. The impact screwdriver 1 has an impact drive device 10 for tightening screws by impact forces. The spindle lock device 20 can be configured to lock a spindle 21 with an anvil 16 against rotation relative to a body case 2. A tool bit B can be attached to the spindle 21.

As shown in FIGS. 1 and 2, an electric motor 3 is disposed within a rear portion of the body case 2 that has a substantially cylindrical tubular configuration. A slide switch 9 is disposed within the upper portion of the body case 2 and can be slidably shifted by an operator for starting the motor 3.

Figure 4:
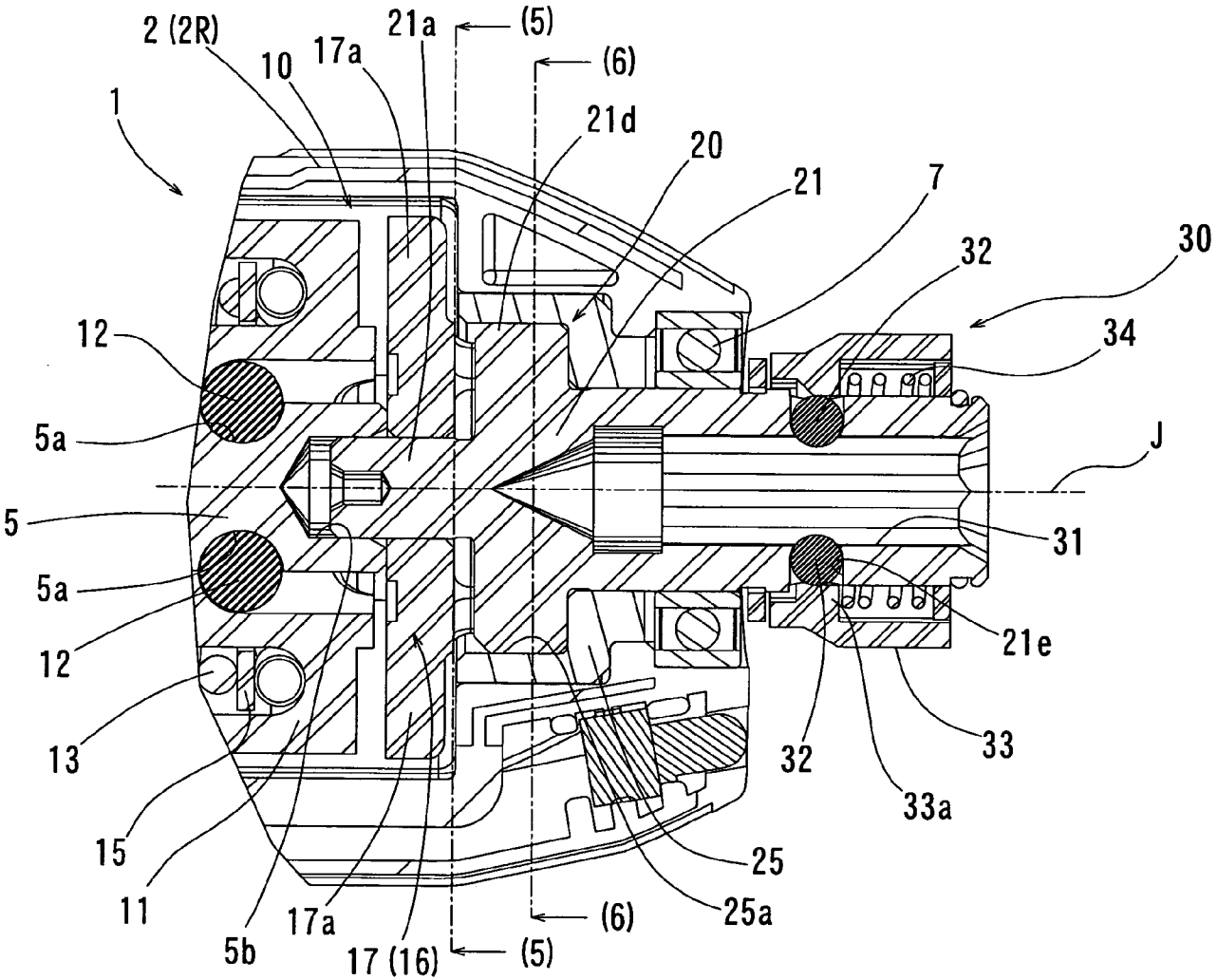
FIG. 4 is an enlarged view of a front portion of the impact screwdriver shown in FIG. 1 and showing an impact device and a spindle lock device in vertical sectional view.
Figure 5:
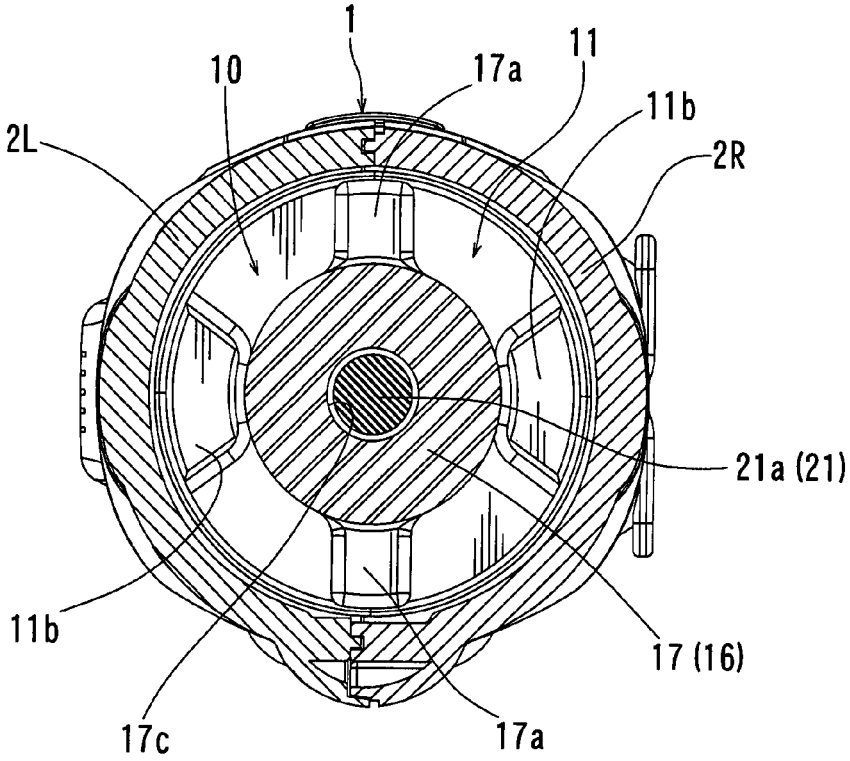
FIG. 5 is a cross sectional view taken along line (5)-(5) in FIG. 4 and showing a horizontal sectional view of the impact device.

As shown in FIG. 2, the body case 2 includes a left case half 2L and a right case half 2R each hang a substantially semicircular configuration in cross section and joined to each other at a joint plane D that extends along the longitudinal axis of the body case 2. In FIGS. 1 and 4, only the right case half 2R, which is positioned on the right side as viewed in a direction of arrow V in FIG. 2, is shown.

A handle 8*a* is pivotally joined to the rear end of the body case 2 via a pivotal shaft 8*a*, so that the handle 8*a* can vertically pivot relative to the body case 2 within a suitable angular range. Therefore, the operator can conveniently perform a screw tightening operation by pivoting the handle 8*a* relative to the body case 2 in response to the requirement at the operation cite.

A drive gear 4*a* is attached to an output shaft 3*a* of the motor 3 and serves as a 9 gear of a planetary gear mechanism 4. The planetary gear 4 has a carrier 4*b*, which can be formed integrally with a drive shaft 5. The rear portion (left portion as viewed in FIG. 1) of the drive shaft 5 is rotatably supported by the body case 2 via a bearing 6. The front portion (right portion as viewed in FIG. 1) of the drive shaft 5 is rotatably supported by the body case 2 via the anvil 16 and a bearing 7. The anvil 16 is rotatably supported by the body case 2 via the bearing 7.

A hammer 11 is axially movably and rotatably supported on the front portion of the drive shaft 5. A pair of steel balls 12 can be interposed in the radial direction between the hammer 11 and the drive shaft 5. The pair of steel balls 12 respectively engage a pair of V-shaped engaging recesses 5*a* formed in the outer circumference of the drive shaft 5 and also respectively engage a pair of engaging recesses 11*a* formed in the inner circumference of the hammer 11.

A compression coil spring 13 is interposed between the hammer 11 and the rear portion of the driver shaft 5, i.e., the carrier 4*b*, respectively via slidable members 14 and 15, so that opposite ends of the spring. 13 can slide relative to the hammer 11 and the carrier 4*b* in the rotational direction.

Figure 7:
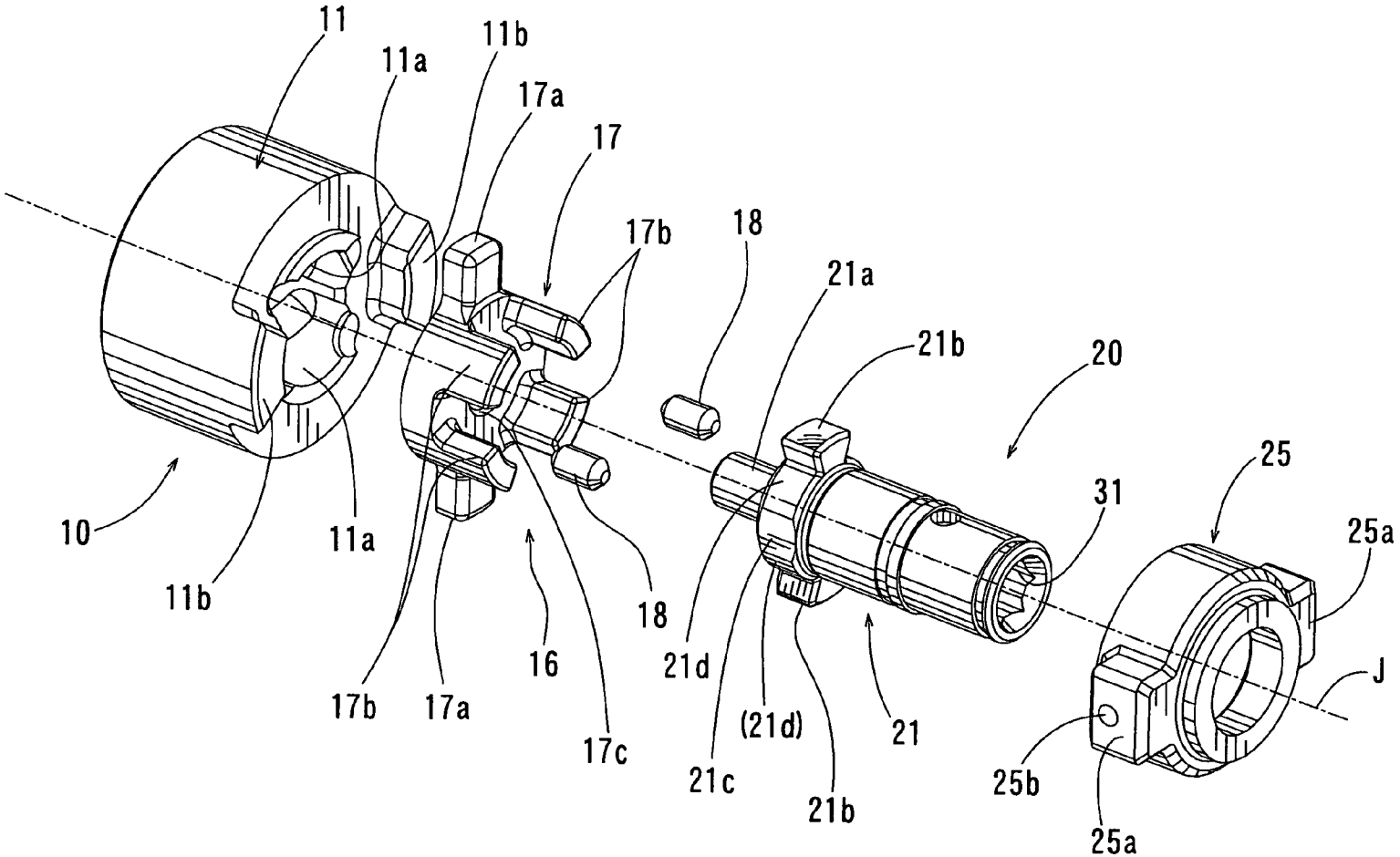
FIG. 7 is an exploded perspective view of the spindle lock device.

As shown in FIG. 7, a pair of projections 11*b* are formed on the front end surface of the hammer 11. As shown, the projections 11*b* can be spaced equally from each other in the circumferential direction and serve to apply impacts on the anvil 16.

In this embodiment, the anvil 16 includes an impact receiving portion 17 and a spindle portion 21 that are configured as separate members from each other. The impact receiving portion 17 is adapted to receive impact forces from the hammer 11. The spindle portion 21 is adapted to receive and attach a driver bit B (see FIG. 1). The impact receiving portion 17 has a pair of impact receiving arms 17*a* corresponding to the pair of projections 11*b* of the hammer 11. The impact receiving arms 17*a* extending radially outward from the impact receiving portion 17 from positions that can be spaced a distance approximately equal from each other in the circumferential direction. Therefore, as the hammer 11 rotates, the projections 11*b* apply impacts on the respective impact receiving arms 17*a* in the rotational direction, so that impact forces are applied to the impact receiving portion 17 of the anvil 16 in a screw tightening direction or a screw loosening direction. In this way, the hammer 11, the steel balls 12 and the impact receiving portion 17 of the anvil 16 constitute the impact device 10.

In addition to the impact receiving arms 17*a*, four engaging parts 17*b* are formed integrally with the impact receiving portion 17. The engaging parts 17*b* can be spaced a distance approximately equal from each other in the circumferential direction and extend forwardly from the impact receiving portion 17 in parallel with each other.

The spindle portion 21 has a rear shaft part 21*a* that is rotatably supported by the impact receiving portion 17 about an axis J, so that the spindle portion 21 can rotate relative to the impact receiving portion 17 about the axis J. More specifically, the support shaft portion 21*a* is rotatably inserted into an insertion hole 17*c* formed in the center of the impact receiving portion 17 and further into a support hole 5*b* formed in the front surface of the drive shaft 5, while no substantial clearance is provided between the support shaft portion 21*a* and the inner circumference of each of the insertion hole 17*c* and the support hole 5*b*. Therefore, the impact receiving portion 17 and the spindle portion 17 are supported on the same axis as the axis J of the drive shaft 5.

A circumferential surface 21*d* is formed in the rear part of the spindle portion 21 and extends in the circumferential direction about the axis J. Two engaging parts 21*b* and two relief surfaces 21*c* are alternately formed on the circumferential surface 21*d* at positions spaced a distance approximately equal from each other in the circumferential direction. The engaging parts 21*b* can be spaced a distance approximately equal from each other in the circumferential direction and extend radially outward from the circumferential surface 21*d*, so that the engaging parts 21*b* can be inserted into respective circumferential spaces between the engaging parts 17*b* of the impact receiving portion 17.

Figure 6:
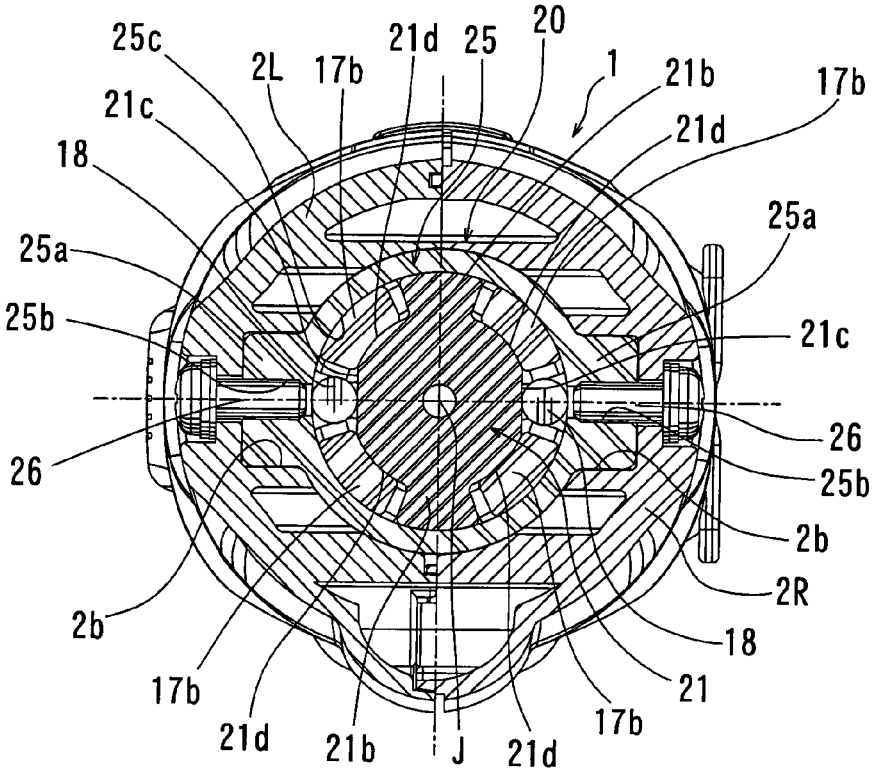
FIG. 6 is a cross sectional view taken along line (6)-(6) in FIG. 4 and showing a horizontal sectional view of the spindle lock device.

As shown in FIG. 6, the circumferential width of each of the engaging parts 21*b* of the spindle portion 21 can be set to be smaller than the circumferential distance between the engaging parts 17*b* of the impact receiving portion 17 in the assembled state. Therefore, the spindle portion 21 can rotate relative to the impact receiving portion 17 by a small angular range.

As shown, the relief surfaces 21*c* can be configured as flat surfaces extending parallel with each other. In addition, the relief surfaces 21*c* can be spaced a distance approximately equal from the axis J of the spindle portion 21. In the assembled state, the relief surfaces 21*c* are positioned radially inside of the spaces between the engaging parts 17*b*, where no engaging parts 21*b* are inserted. An engaging member 18 is received within each of these spaces. In this embodiment, the engaging member 18 can be a cylindrical pin with a diameter R. The engaging member 18 will be explained later in more detail.

An engaging ring 25 is disposed on the outer circumferential side of the engaging parts 17*b* of the impact receiving portion 17. The engaging ring 25 has a substantially cylindrical tubular configuration and has a pair of mount portions 25*a* formed integrally with the engaging ring 25. The mount portions 25*a* are spaced equally from each other in the circumferential direction and projecting radially outward from the engaging ring 25. A threaded hole 25*b* is formed in each mount portion 25*a*. The engaging parts 17*b* of the impact receiving portion 17 and the spindle portion 21 of the anvil 16 are respectively rotatably received within the engaging ring 25.

The engaging ring 25 is clamped between front portions of the left case half 2L and the right case half 2R of the body case 2 so as to be fixed in position relative to the body case 2. Mount recesses 2*b* are respectively formed in the inner circumferences of the left case half 2L and the right case half 2R in positions diametrically opposed to each other in order to receive the mount portions 25*a* of the engaging ring 25 such that no substantial clearance is provided in the circumferential direction between the mount portions 25*a* and opposing walls of each mount recess 2*b*.

Fixing screws 26 are inserted into the left case half 2L and the right case half 2R from the outer side and are engaged with respective threaded holes 25*b* formed in the mount portions 25*a*. Therefore, by tightening the fixing screws 26, the engaging ring 25 can be fixed in position not to move in the rotational direction and the axial direction in such a manner that the engaging ring 25 is clamped between the front portions of the left case half 2L and the right case half 2R. In other words, the front portions of the left case half 2L and the right case half 2R can be joined to each other via the engaging ring 25, while they contact with each other in the diametrical direction.

In this way, in the assembled state, the four engaging parts 17*b* of the impact receiving portion 17 are respectively positioned between an inner circumferential surface 25*c* of the engaging ring 25, which is fixed within the front portion of the body case 2, and the circumferential surface 21*d* of the spindle portion 21 of the anvil 16 at four equally spaced positions. In addition, the engaging members 18 are positioned between the inner circumferential surface 25*c* of the engaging ring 25 and the relief surfaces 21*c* of the spindle portion 21.

Figure 8:
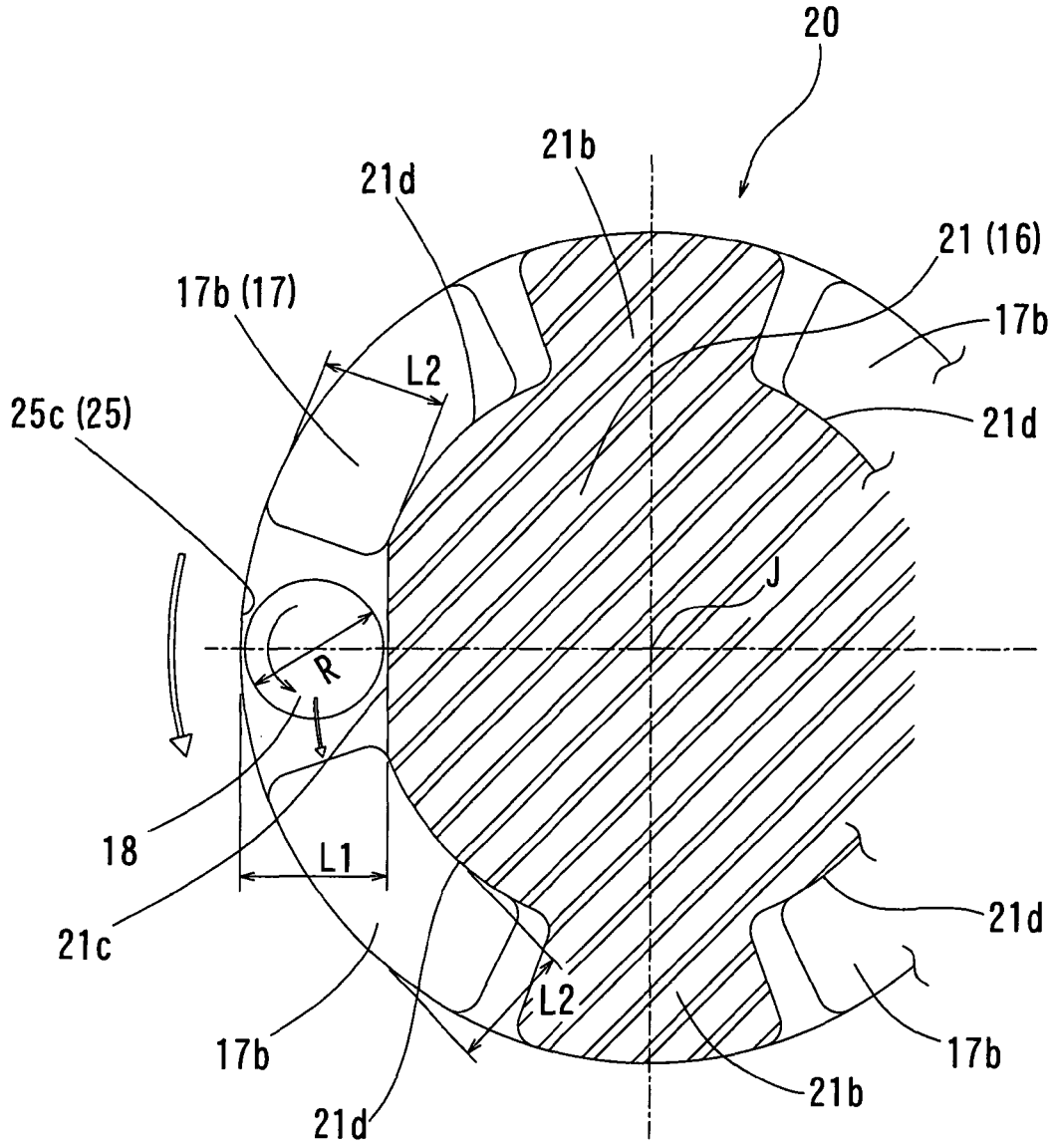
FIG. 8 is a schematic vertical sectional view of the spindle lock device as viewed from the front side of the front portion of the screwdriver in a direction of arrow V in FIG. 2

As shown in FIG. 8, the diameter R of each engaging member 18 is set to be slightly smaller than a maximum distance L1 between the inner circumferential surface 25*c* of the engaging ring 25 and the corresponding relief surface 21*c* of the spindle portion 21. Thus, the engaging member 18 can move in the circumferential direction along the relief surface 21*c* as long as the distance between the inner circumferential surface 25*c* of the engaging ring 25 and the corresponding relief surface 21*c* of the spindle portion 21 is larger than the diameter R (i.e., as long as a clearance is provided between the engaging member 18 and the inner circumferential surface 25*c* or the relief surface 21*c*).

Therefore, if the engaging member IS moves in the circumferential direction of the engaging ring 25 (upper and lower directions in the case of the engaging member 18 shown in FIG. 8), the engaging member 18 can wedge between the relief surface 21*c* and the inner circumferential surface 25*c*. When this occurs, the spindle portion 21 is prevented from rotating relative to the engaging ring 25 and eventually to the body case 2, so that the spindle portion 21 is locked against its rotation.

Thus, as the operator rotates the engaging ring 25 or the body case 2 relative to the spindle portion 81 in a counterclockwise direction as indicated by outline arrow in FIG. 8, which corresponds to a screw tightening direction, the engaging members 18 move in the same direction toward the circumferential end of the corresponding relief surfaces 21*c* (downward in the case of the engaging member 18 shown in FIG. 8), while the engaging members 18 rotate in the counterclockwise direction due to the frictional force produced against the inner circumferential surface 25*c* of the engaging ring 25. Therefore, the engaging member 18 shown in FIG. 8 wedges between the relief surface 21*c* on the side of the circumferential end and the inner circumferential surface 25*c*. Similarly, another engaging member 18 that is not shown in FIG. 18 and positioned on the right side of FIG. 8 wedges between the corresponding relief surface 21*c* on the side of the circumferential end (upper circumferential end) and the inner circumferential surface 25*c*.

Figure 9:
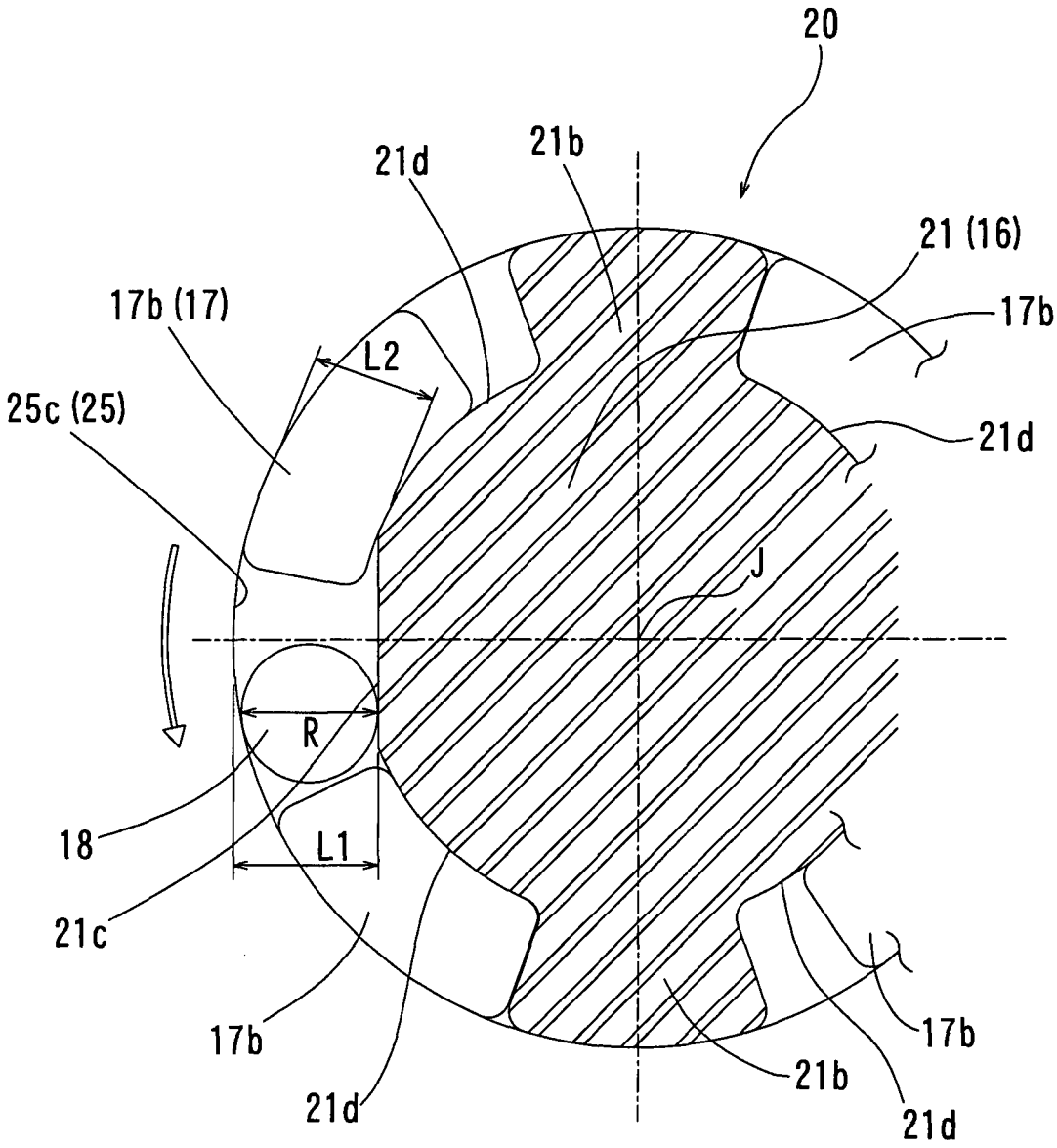
FIG. 9 is a schematic vertical sectional view similar to FIG. 8 but showing a spindle lock position resulted when the screwdriver has rotated in a screw tightening direction.

As described above, the spindle portion 21 can be locked with respect to rotation in the screw tightening direction against the body case 2 by the wedging operation of the engaging members 18 between their corresponding relief surfaces 21*c* of the spindle portion 21 and the inner circumferential surface 25*c* of the engaging ring 25. The lock positions of one of the engaging members 18 is shown in FIG. 9.

Figure 10:
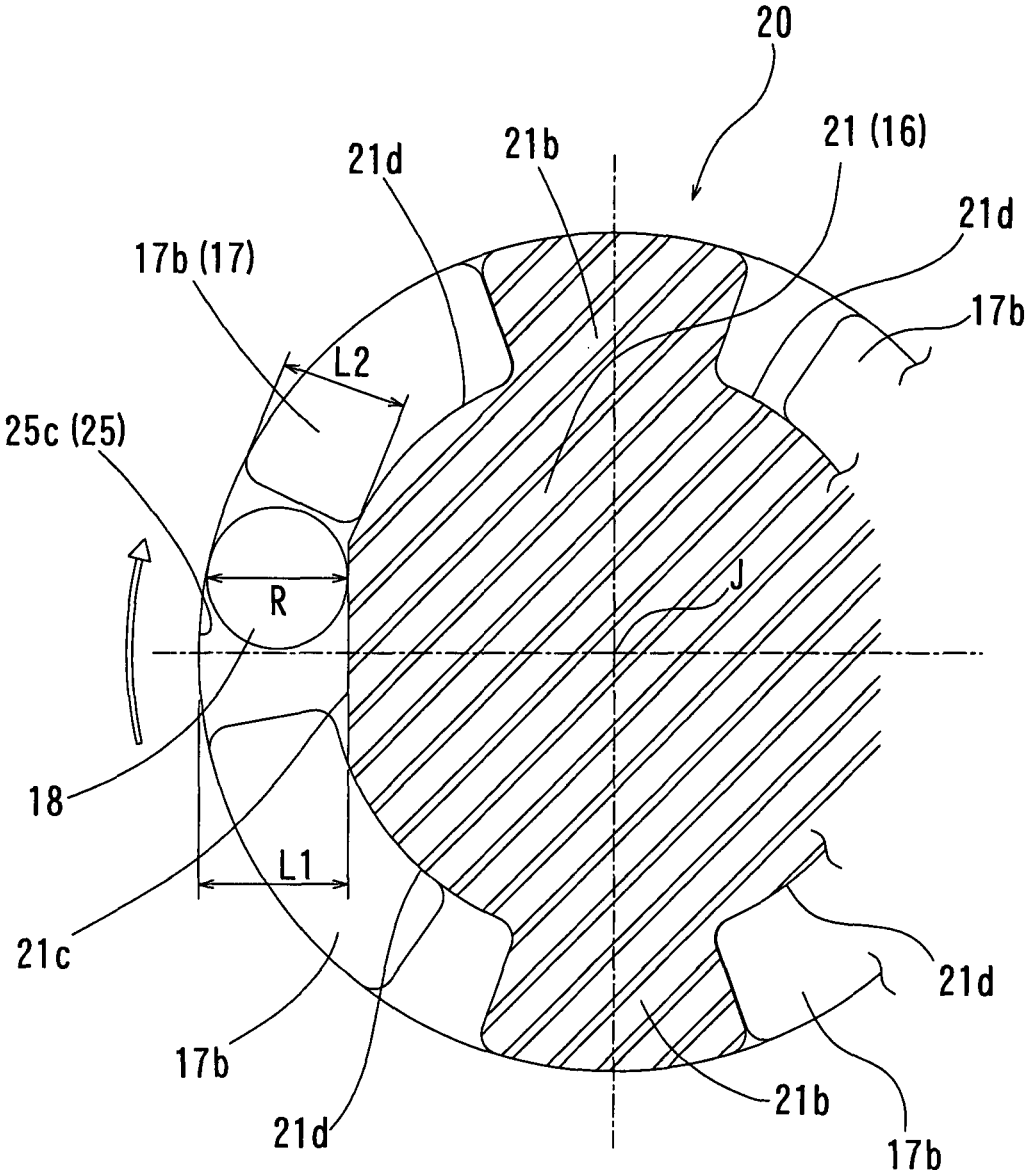
FIG. 10 is a schematic vertical sectional view similar to FIG. 8 but showing a spindle lock position resulted when the screwdriver has rotated in a screw loosening direction.

Also, as the operator rotates the engaging ring 25 or the body case 2 relative to the spindle portion 81 in a clockwise direction as indicated by outline arrow in FIG. 10, which corresponds to a screw loosening direction, the engaging members 18 move in the same direction toward the upper circumferential end of the relief surface 21*c*, while the engaging members 18 rotate due to the frictional force produced against the inner circumferential surface 25*c* of the engaging ring 25. Therefore, the engaging member 18 shown in FIG. 10 moves upward to wedge between the corresponding relief surface 21*c* on the side of the circumferential end and the inner circumferential surface 25*c*. Similarly, another engaging member 18 that is not shown in FIG. 10 and positioned on the right side of FIG. 10 moves downward to wedge between the corresponding relief surface 21*c* on the side of the circumferential end (lower circumferential end) and the inner circumferential surface 25*c*. engaging members 18 is shown in FIG. 9.

In this way, the engaging ring 25, the engaging members 18, the relief surfaces 21*c* and the circumferential surface 21*d* of the spindle portion 21 constitute the spindle lock device 20. The spindle portion 21 can be locked with respect to the rotation relative to the body case 2 in either situation when the body case 2 is rotated in the screw tightening direction or in the screw loosening direction.

Therefore, if the operator rotates the body case 2 in the screw tightening direction after engaging the driver bit with a screw (not shown) to be tightened, the spindle portion 21 can be locked against rotation relative to the body case 2 by the operation of the spindle lock device 20, so that the spindle portion 21 can rotate with the body case 2 in order to further tighten the screw. On the other hand, if the operator rotates the body case 2 in the screw loosening direction, the spindle portion 21 can be also locked against rotation relative to the body case 2 by the operation of the spindle lock device 20, so that the spindle portion 21 can rotate with the body case 2 in order to further loosen the screw.

In order to release the lock condition of the spindle portion 21, the operator may rotate the body case 2 in an opposite direction to the direction for the locking operation by a small distance, so that the engaging members 18 move toward the central portions of the corresponding relief surfaces 21*c* by the fictional force produced between the body case 2 and the engaging members 18. As a result, the wedging condition of the engaging members 18 between the inner circumferential surface 25*c* of the engaging ring 25 and the end portions of the corresponding relief surfaces 21*c* is reliably released.

The wedging condition of the engaging members 18 can be also released by starting the motor 3. The motor 3 can be started by slidably shifting the switch 9 from the OFF position to the ON position. For example, if the motor 3 is started to rotate in the screw tightening direction on the condition that the spindle portion 21 has been locked by the movement of the body case 2 in the tightening direction as shown in FIG. 9, the impact receiving portion 17 of the impact device 10 rotates in the counterclockwise direction as viewed in FIG. 9. Therefore, the engaging portions. 17*b* of the impact receiving portion 17 contact with the engaging portions 21*b* of the spindle portion 21 to force the spindle portion 21 so as to rotate in the counterclockwise direction. As a result, engaging members 18 move toward the central portions of the relief surfaces 21*c*, so that the lock condition of the spindle portion 21 can be rapidly released.

As the impact receiving portion 17 continues to rotate the spindle portion 21 in the screw tightening direction after the spindle lock condition has been thus released, a usual tightening operation can be performed while the engaging members 18 are held in the central positions of the relief surfaces 21*c* and are prevented from moving into the wedging position by the engaging portions 17*b* that are positioned on the rear side (the side opposite to the rotational direction) of the engaging members 18. Therefore, during the usual screw tightening operation that is performed by stating the motor 3, the lock device 20 is not effective, and the spindle portion 21 rotates in unison with the drive shaft 5, or the spindle 21 intermittently rotates in the tightening direction by the impact action of the rotating hammer 11.

In this way, according to this embodiment, the lock device 20 is not effective when the motor 3 is started for performing the usual screw tightening operation, and the lock device 20 becomes effective only when the body case 2 is rotated relative to the spindle 12 or the tool bit B engaging the screw, on the condition that the motor 3 is not rotated. In addition, it is possible to provide the lock condition with respect to either the screw tightening direction or the screw releasing direction.

As shown in FIG. 1, a bit mounting device 30 for mounting the tool bit 3 is provided on the front portion of the spindle portion 21. The bit mounting device 30 includes a bit receiving hole 31 formed in the front portion of the spindle portion 21 in the axial direction. A pair of steel balls 32 are radially movably received within corresponding radial holes 21*e* formed in the spindle portion 21 and communicating with the bit receiving hole 31. The bit mounting device 30 further includes a lock ring 33 slidably fitted on the outer peripheral surface of the front portion of the spindle portion 21, so that the lock ring 33 can move in the direction of the axis J of the spindle portion 21. A compression spring 34 biases the lock ring 33 toward a lock position leftward as viewed in FIG. 1). A lock projection 33*a* extends along the inner circumference of the lock ring 33 and protrudes radially inward from the inner circumference of the lock rug 33. When the lock ring 33 is in a lock position (left side position shown in FIG. 1), the lock projection 33*a* opposes to the steel balls 32 in the radial direction from their outer side. In this state, the steel balls 32 can partly protrude into the bit receiving hole 31 in order to engage the corresponding engaging recess formed in the tool bit B. Therefore, the tool bit B can be prevented from being removed from the bit receiving hole 31. When the operator moves the lock ring 33 axially forwardly against the biasing force of the spring 34, the lock projection 33*a* moves away from the radially outer side of the steel balls 32, so that the steel balls 32 are allowed to move radially outward. In this state, the tool bit B can be removed from or inserted into the bit receiving hole 31.

According to the embodiment described above, when the operator rotates the body case 2 or the entire screw tightening tool 1 in either the screw tightening direction or the loosening direction on the condition that the motor 3 is stopped after the usual tightening or loosening operation that is performed by starting the motor 3, the spindle lock device 20 locks the spindle portion 21 and eventually the tool bit B with respect to the rotation relative to the case body 2. Therefore, it is possible to further tighten or loosen the screw by rotating the case body 2 subsequent to the completion of the tightening or loosening operation by a predetermined torque by the rotation of the motor 3. It is not necessary to use a separate manually driven screwdriver in order to further tighten or loosen the screw.

Further, in general, the diameter of the body case 2 is larger than a diameter of a commonly used manually driven screwdriver. Therefore, it is possible to firmly tighten the screw by a large force than a force available when using the manually driven screwdriver. In addition, it is possible to easily loosen the screw that has been tightened by a large force.

The above embodiment may be modified in various ways. For example, although the engaging members 18 are configured as pins having a cylindrical configuration, the engaging members 18 may have a spherical configuration. Further, although one engaging member 18 is positioned between two engaging portions 17*b*, two or more engaging members 18 can be provided.

This invention claims:

1. A spindle lock device in a screwdriver, the screwdriver comprising:

a body case;

an electric motor disposed within the body case;

a drive shaft rotatably driven by the electric motor;

a hammer having a rotational axis and axially movably and rotatably supported on the drive shaft;

an anvil having a spindle portion that is rotatable about the rotational axis of the hammer, the spindle portion being configured to mount a driver bit to the spindle portion; and an impact device configured such that the hammer impacts on the anvil in a rotational direction while the hammer reciprocates in an axial direction;

the spindle lock device comprising:

an engaging ring fixed in position relative to the body case, wherein the anvil is disposed inside of the engaging ring;

a flat relief surface defined on an outer circumference of the anvil; and an engaging member disposed between the engaging ring and the flat relief surface of the anvil;

wherein the engaging member is configured to wedge between the engaging ring and an end portion of the flat relief surface in a circumferential direction of the relief surface of the anvil, whereby the anvil is locked with respect to rotation relative to the body case;

wherein when the anvil is locked, the spindle portion is prevented from rotating relative to the engaging ring and the body case;

wherein the engaging member includes a cylindrical pin, wherein the cylindrical pin rotates along the flat relief surface to wedge between the engaging ring and the end portion of the relief surface as the engaging ring is rotated relative to the anvil, whereby the engaging member directly contacts the engaging ring;

wherein the anvil includes an impact receiving portion and the spindle portion separated from each other;

wherein the impact receiving portion includes first engaging portions;

wherein the spindle portion includes a second engaging portion engageable with the first engaging portions in the rotational direction, and the spindle portion is configured to rotate relative to the impact receiving portion about the rotational axis within a predetermined range;

wherein the flat relief surface is positioned on a circumferential surface of the spindle portion;

wherein the engaging member is positioned between the first engaging portions of the impact receiving portion in the circumferential direction; and wherein the engaging member is non-elastic.

2. An impact screwdriver, comprising:

a hammer rotatably driven by a motor;

an anvil comprising an impact receiving portion and a spindle portion rotatable relative to the impact receiving portion, the spindle portion being configured to accommodate mounting of a driver bit to the spindle portion, wherein the impact receiving portion rotates as the hammer applies an impact on the impact receiving portion in a rotational direction; and a lock device including an operation member and a lock member, wherein the lock member releasably locks the spindle portion from rotation relative to the operation member, wherein the operation member includes a lock ring rotatable relative to the spindle portion about a rotational axis;

the spindle portion is disposed within the lock ring;

the lock member is positioned between the lock ring and the spindle portion and is movable between a lock position and an unlock position in response to rotation of the lock ring;

when the lock member is in the lock position, the spindle portion is prevented from rotating relative to the operation member; and the lock member is non-elastic.

3. The impact screw driver as in claim 2, wherein:

the lock ring includes an inner circumferential surface;

the spindle portion includes a control surface opposed to the inner circumferential surface of the lock ring in a radial direction;

wherein the lock member is disposed within a lock space defined between the inner circumferential surface of the lock ring and the control surface of the spindle portion;

the lock space has a radial distance decreasing from a central portion of the control surface in the circumferential direction toward opposite ends of the control surface;

wherein the radial distance of the lock space at the central position of the control surface is greater than a size of the lock member in the radial direction;

wherein the radial distance of the lock space at the opposite ends of the control surface is smaller than the size of the lock member in the radial direction; and wherein the lock member wedges between the lock ring and the control surface as the lock member moves from a position opposing to the central portion of the control surface toward positions opposing to the end portions of the control surface.

4. The impact screwdriver as in claim 3, wherein the lock member includes a rolling member that can rotate along the control surface.

5. The impact screwdriver as in claim 3, wherein the impact receiving portion includes first engaging portions spaced from each other in the rotational direction;

the spindle portion includes second engaging portions spaced from each other in the rotational direction;

the second engaging portions respectively oppose to the first engaging portions in the rotational direction while permitting rotation of the spindle portion relative to the impact receiving portion within an angle of rotation; and the lock space is defined between two of the first engaging portions.

6. The impact screwdriver as in claim 2, further comprising a body case capable of rotatably receiving the hammer and the anvil, wherein the operation member is attached to the body case, so that the operation member can rotate together with the body case relative to the anvil.

7. The impact screwdriver as in claim 2, further comprising a body case being configured to rotatably receive the hammer and the anvil, wherein the operation member is attached to the body case, so that the operation member can rotate together with the body case relative to the anvil.

8. An impact screwdriver, comprising:

a hammer capable of being rotatably driven by a motor about an axis;

an anvil capable of rotation around the axis, the anvil including an impact receiving portion and a spindle portion capable of rotation relative to the impact receiving portion, the spindle portion being configured such that a driver bit can be mounted to the spindle portion, the impact receiving portion being configured to be rotatable as the hammer applies an impact on the impact receiving portion in a rotational direction; and a lock device including an operation member and a lock member, wherein the lock member releasably locks the spindle portion from rotation relative to the operation member, wherein when the lock member locks the spindle portion, the spindle portion is prevented from rotating relative to the operation member;

wherein the operation member includes a lock ring rotatable relative to the spindle portion about a rotational axis;

wherein the spindle portion is disposed within the lock ring;

wherein the lock member is positioned between the lock ring and the spindle portion and is movable between a lock position and an unlock position in response to rotation of the lock ring; and wherein the lock member is non-elastic.

9. The impact screw driver as in claim 8, wherein the lock ring includes an inner circumferential surface.

10. The impact screwdriver as in claim 9, wherein the spindle portion includes a control surface opposed to the inner circumferential surface of the lock ring in a radial direction.

11. The impact screwdriver as in claim 10, wherein the lock member is disposed within a lock space defined between the inner circumferential surface of the lock ring and the control surface of the spindle portion, the lock space having a radial distance decreasing from a central portion of the control surface in a circumferential direction toward opposite ends of the control surface, and wherein the radial distance of the lock space at the central portion of the control surface is greater than a size of the lock member in the radial direction.

12. The impact screwdriver as in claim 11, wherein the radial distance of the lock space at the opposite ends of the control surface is smaller than the size of the lock member in the radial direction, and wherein the lock member is configured to wedge between the lock ring and the control surface as the lock member moves from a position opposing to the central portion of the control surface toward positions opposing to the end portions of the control surface.

13. The impact screwdriver as in claim 12, wherein the lock member includes a rolling member that can rotate along the control surface.

14. The impact screwdriver as in claim 12, wherein the impact receiving portion includes first engaging portions spaced from each other in the rotational direction;

the spindle portion includes second engaging portions spaced from each other in the rotational direction;

the second engaging portions respectively oppose the first engaging portions in the rotational direction while permitting rotation of the spindle portion relative to the impact receiving portion within an angle of rotation; and the lock space is defined between two of the first engaging portions.

* * * * *